US009890570B2

(12) United States Patent
Horwood

(10) Patent No.: US 9,890,570 B2
(45) Date of Patent: Feb. 13, 2018

(54) SLIDING DOOR OR WINDOW LATCH

(71) Applicant: ASSA ABLOY NEW ZEALAND LIMITED, Auckland (NZ)

(72) Inventor: Stuart Horwood, Melbourne (AU)

(73) Assignee: Assa Abloy New Zealand Ltd., Rosedale, Auckland (NZ)

( * ) Notice: Subject to any disclaimer, the term of this patent is extended or adjusted under 35 U.S.C. 154(b) by 569 days.

(21) Appl. No.: 14/329,515

(22) Filed: Jul. 11, 2014

(65) Prior Publication Data

US 2015/0021932 A1 Jan. 22, 2015

(30) Foreign Application Priority Data

Jul. 18, 2013 (NZ) ..... 613385

(51) Int. Cl.

| | |
|---|---|
| ***E05C 3/16*** | (2006.01) |
| ***E05C 3/12*** | (2006.01) |
| ***E05F 5/08*** | (2006.01) |
| ***E05B 63/18*** | (2006.01) |
| ***E05B 65/08*** | (2006.01) |
| ***E05B 15/00*** | (2006.01) |
| *E05C 3/00* | (2006.01) |

(52) U.S. Cl.

CPC ..... *E05C 3/124* (2013.01); *E05B 15/0086* (2013.01); *E05B 63/185* (2013.01); *E05B 65/0811* (2013.01); *E05F 5/08* (2013.01); *Y10S 292/46* (2013.01); *Y10T 16/299* (2015.01); *Y10T 292/1052* (2015.04); *Y10T 292/1056* (2015.04)

(58) Field of Classification Search

CPC ..... Y10S 292/46; Y10T 292/707; Y10T 292/1052; Y10T 292/1056

USPC ..... 70/107–111

See application file for complete search history.

(56) References Cited

U.S. PATENT DOCUMENTS

| | | | | |
|---|---|---|---|---|
| 186,341 | A * | 1/1877 | Hance | E05C 19/028 220/326 |
| 641,269 | A * | 1/1900 | Clay | E05B 65/0864 292/DIG. 46 |
| 1,059,530 | A * | 4/1913 | Dupuis | E05B 15/0245 292/341.19 |
| 1,090,305 | A * | 3/1914 | Hoffman | E05B 65/0864 292/333 |
| 1,214,227 | A * | 1/1917 | Schwenk | E05B 15/0245 292/341.19 |
| 1,297,528 | A * | 3/1919 | Wright | E05B 15/0245 292/341.19 |
| 2,028,954 | A | 1/1936 | Roedding | |
| 2,401,854 | A * | 6/1946 | Berry, Jr. | E05B 15/0245 292/341.19 |

(Continued)

FOREIGN PATENT DOCUMENTS

GB 2212849 8/1989

*Primary Examiner* — Carlos Lugo

(74) *Attorney, Agent, or Firm* — DeLio, Peterson & Curcio, LLC; Thomas E. Ciesco

(57) ABSTRACT

A latch includes a protrusion that extends from a latch body. The protrusion moves from a fully extended position to a partially extended position when the door or window to which the latch is mounted is moved to a closed position. This movement of the protrusion disengages an anti-slam mechanism, allowing movement of a latch mechanism. Further, the partially extended protrusion engages in an anti-lift recess in the strike. Alternatively, the protrusion may extend from the strike and engage with an anti-lift recess in the latch body.

11 Claims, 13 Drawing Sheets

(56) References Cited

U.S. PATENT DOCUMENTS 2,861,660 A 11/1958 Ensign
4,434,635 A * 3/1984 Borgato ..... E05B 47/0002 292/108
4,475,313 A 10/1984 Governale
4,915,428 A 4/1990 Hayakawa
5,083,448 A * 1/1992 Karkkainen ..... E05B 47/0012 292/144
5,469,723 A * 11/1995 Litwin ..... E05B 35/007 70/107
5,595,409 A * 1/1997 Fier ..... E05B 17/042 292/112
6,045,169 A * 4/2000 Frolov ..... E05B 63/044 292/332
6,550,824 B1 4/2003 Ramsauer
7,178,839 B2 * 2/2007 Tsai ..... E05B 65/0858 292/112
7,207,608 B2 * 4/2007 Monts de Oca .... E05B 15/0245 292/341.18
7,353,674 B2 * 4/2008 Raatikainen ..... E05B 47/0688 70/107
7,431,354 B2 * 10/2008 Raatikainen ..... E05B 59/00 292/137
7,837,241 B2 * 11/2010 Chung ..... E05B 63/185 292/199
8,523,247 B2 * 9/2013 Talpe ..... E05B 17/042 292/280
8,931,812 B1 * 1/2015 Hauber ..... E05B 63/185 292/24
2008/0265587 A1 * 10/2008 Nakanishi ..... E05B 63/042 292/26
2009/0151407 A1 * 6/2009 Lin ..... E05B 59/00 70/107
2011/0296880 A1 * 12/2011 Sieglaar ..... E05B 13/108 70/100

* cited by examiner

SLIDING DOOR OR WINDOW LATCH

BACKGROUND OF THE INVENTION

1. Field of the Invention

The invention relates to sliding door or window latches, in particular to latches with anti-slam and anti-lift functions.

2. Description of Related Art

Sliding doors and windows are widely used in residential and commercial settings. Sliding doors and windows may include a single sliding panel moving relative to a frame, or two or more panels moveable relative to the frame. Latches are used to secure the sliding panels to the frame and/or to each other in order to provide a secure latched state for the door or window.

Latches for sliding doors and windows generally include a latch body that includes one or more hooks. The latch body is usually mounted to the sliding window or door panel, with a strike mounted either to the frame or to a second sliding window or door panel. The hooks rotate from a withdrawn position within the latch body to an extended position. In the extended position the hooks will engage with the strike, thereby securing the latch body to the strike and the sliding window or door panel either to the frame or the other sliding panel.

Sliding doors and windows can be slammed forcefully in use. If the latch hooks are extended from the latch body during forceful closing of the door, the latch mechanism can be damaged. Further, it is generally not possible to move the door to the fully closed position while the latch hooks are extended. For this reason sliding door and window latches sometimes include an anti-slam mechanism. This generally includes a mechanism mounted in the latch body that restricts motion of the latch hooks into the extended position, unless the latch body is in close proximity to the strike, i.e. unless the door is already closed. This mechanism can be actuated by a biased pin that extends from the latch body. As the latch body approaches the strike, the pin is forced to retract into the latch body. Retraction of the pin disengages the anti-slam mechanism and this removes the restriction on movement of the latch hooks.

Intruders sometimes attempt to lift sliding doors and windows off the latch hook. This is done by prying the latch hook upwards relative to the strike in an attempt to disengage the latch hook from the strike. To guard against this possibility, latches sometimes include formations on the latch body and strike that cooperate to restrict this vertical motion.

Reference to any prior art in this specification does not constitute an admission that such prior art forms part of the common general knowledge.

It is an object of the invention to provide an improved sliding door or window latch, in particular to provide an improved anti-slam, anti-lift mechanism, or at least to provide the public with a useful choice.

SUMMARY OF THE INVENTION

In a first aspect the invention provides a sliding door or window latch, including:

a strike including:
- a latch engagement element;
- an anti-lift formation; and
- an anti-slam contact surface;

a latch body, including:
- a latch housing;
- a latch member mounted in the latch housing, configured to move between: an unlatched position; and a latched position in which, in use, the latch member is positioned to engage with the latch engagement element;
- a protrusion that extends from the latch housing and is:
  - movable between a fully extended position and a partially extended position; and
  - biased to extend from the latch body to the fully extended position; an anti-slam mechanism actuated by the protrusion, wherein the anti-slam mechanism restricts motion of the latch member from the unlatched position when the protrusion is in the fully extended position but allows motion of the latch member from the unlatched position when the protrusion is in the partially extended position;

wherein, when, in use, a sliding door or window to which the latch is mounted is moved to a closed position, the protrusion:
- contacts the anti-slam contact surface and is forced by relative movement of the strike and latch body to move from the fully extended position to the partially extended position, thereby actuating the anti-slam mechanism to allow movement of the latch member from the unlatched position; and
- engages with the anti-lift formation thereby preventing vertical movement of the latch body relative to the strike.

Preferably the protrusion includes a shoulder that contacts the anti-slam contact surface and an end portion extending beyond the shoulder that engages in the anti-lift formation.

Preferably the latch member is a latch hook and the latch engagement element is an aperture in the strike.

Preferably the latch includes a drive element driven by a user actuator and configured to drive movement of the latch member between the latched and unlatched positions.

Preferably the anti-slam mechanism includes a first anti-slam formation on the drive element and a second anti-slam formation that engages with the first anti-slam formation to prevent movement of the drive element.

Preferably movement of the protrusion from the fully extended position to the partially extended position causes disengagement of the second anti-slam formation from the first anti-slam formation, thereby allowing movement of the drive element.

Preferably the latch includes a security element configured to prevent unlatching motion of the drive element, wherein the security element is caused to disengage by unlatching motion of the user actuator.

Preferably the anti-slam contact surface is a front surface of the strike. Alternatively the anti-slam contact surface may be recessed within the strike.

Preferably the strike includes a rear element configured for fixing to a door or window frame or a sliding door or window panel, and a front element adjustably mounted to the rear element. Preferably the anti-lift formation is formed in the front element.

Preferably the anti-lift formation is an aperture in the strike.

Preferably the latch includes a security element configured to prevent unlatching motion of the latch member, wherein the security element is caused to disengage by unlatching motion of a user actuator.

In a further aspect the invention provides a sliding door or window latch, including:

a strike including:
- a latch engagement element;
- a protrusion;

a latch body, including:

a latch housing;

a latch member mounted in the latch housing, configured to move between: an unlatched position; and a latched position in which, in use, the latch member is positioned to engage with the latch engagement element;

an anti-lift formation;

an anti-slam mechanism including an anti-slam element movable between a first position and a second, retracted, position, and biased to the first position; wherein the anti-slam mechanism restricts motion of the latch member from the unlatched position when the anti-slam element is in the first position but allows motion of the latch member from the unlatched position when the anti-slam element is in the second position;

wherein, when, in use, a sliding door or window to which the latch is mounted is moved to a closed position, the protrusion:

forces the anti-slam element to move from the first position to the second position, thereby actuating the anti-slam mechanism to allow movement of the latch member from the unlatched position; and engages with the anti-lift formation thereby preventing vertical movement of the latch body relative to the strike.

Preferably the latch member is a latch hook and the latch engagement element is an aperture in the strike.

Preferably the latch includes a drive element driven by a user actuator and configured to drive movement of the latch member between the latched and unlatched positions.

Preferably the anti-slam mechanism includes a first anti-slam formation on the drive element and a second anti-slam formation that engages with the first anti-slam formation to prevent movement of the drive element.

Preferably the latch includes a security element configured to prevent unlatching motion of the drive element, wherein the security element is caused to disengage by unlatching motion of the user actuator.

Preferably the strike includes a rear element configured for fixing to a door or window frame or a sliding door or window panel, and a front element adjustably mounted to the rear element.

Preferably the protrusion is formed in the front element.

Preferably the latch includes a security element configured to prevent unlatching motion of the latch member, wherein the security element is caused to disengage by unlatching motion of a user actuator.

In another aspect the invention provides a sliding door or window latch including:

a strike including a latch engagement element;

a latch body including:

a latch housing;

a latch member mounted in the latch housing, configured to move between: an unlatched position; and a latched position in which, in use, the latch member is positioned to engage with the latch engagement element;

an anti-lift protrusion provided on either the strike or the latch body, and an anti-lift formation provided on the other of the strike or latch body, the anti-lift protrusion and anti-lift formation being configured and positioned to cooperate with each other to limit vertical movement of the latch body relative to the strike, in the latched position;

an anti-slam mechanism actuated by the anti-lift protrusion wherein the anti-slam mechanism restricts motion of the latch member from the unlatched position when a door or window to which the latch is mounted is open but allows motion of the latch member from the unlatched position when the door or window is closed.

Preferably the protrusion is provided on the latch body and the anti-lift formation is provided on the strike.

Preferably the protrusion includes a shoulder that contacts an anti-slam contact surface and an end portion extending beyond the shoulder that engages in the anti-lift formation.

Preferably the latch member is a latch hook and the latch engagement element is an aperture in the strike.

Preferably the latch includes a drive element driven by a user actuator and configured to drive movement of the latch member between the latched and unlatched positions.

Preferably the anti-slam mechanism includes a first anti-slam formation on the drive element and a second anti-slam formation that engages with the first anti-slam formation to prevent movement of the drive element.

Preferably movement of the protrusion from the fully extended position to the partially extended position causes disengagement of the second anti-slam formation from the first anti-slam formation, thereby allowing movement of the drive element.

Preferably the latch includes a security element configured to prevent unlatching motion of the drive element, wherein the security element is caused to disengage by unlatching motion of the user actuator.

Preferably the strike includes a rear element configured for fixing to a door or window frame or a sliding door or window panel, and a front element adjustably mounted to the rear element.

Preferably the anti-lift formation is formed in the front element.

Preferably the anti-lift formation is an aperture in the strike.

BRIEF DESCRIPTION OF THE DRAWINGS

The invention will now be described by way of example only, with reference to the accompanying drawings, in which.

DESCRIPTION OF THE PREFERRED EMBODIMENT(S)

Figure 1:
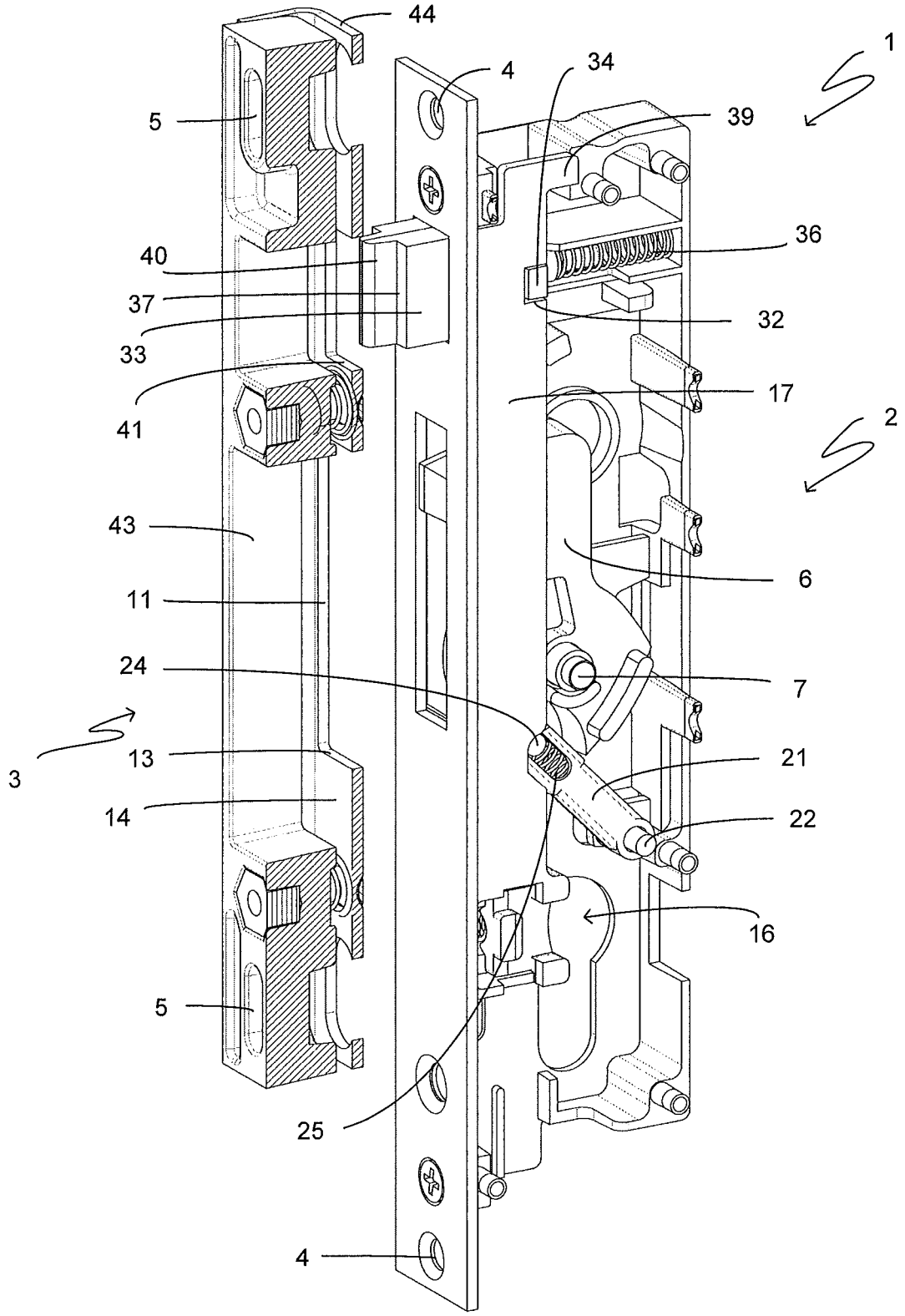
FIG. 1 is a cut away perspective view of a latch according to one embodiment, in an unlatched position.
Figure 2:
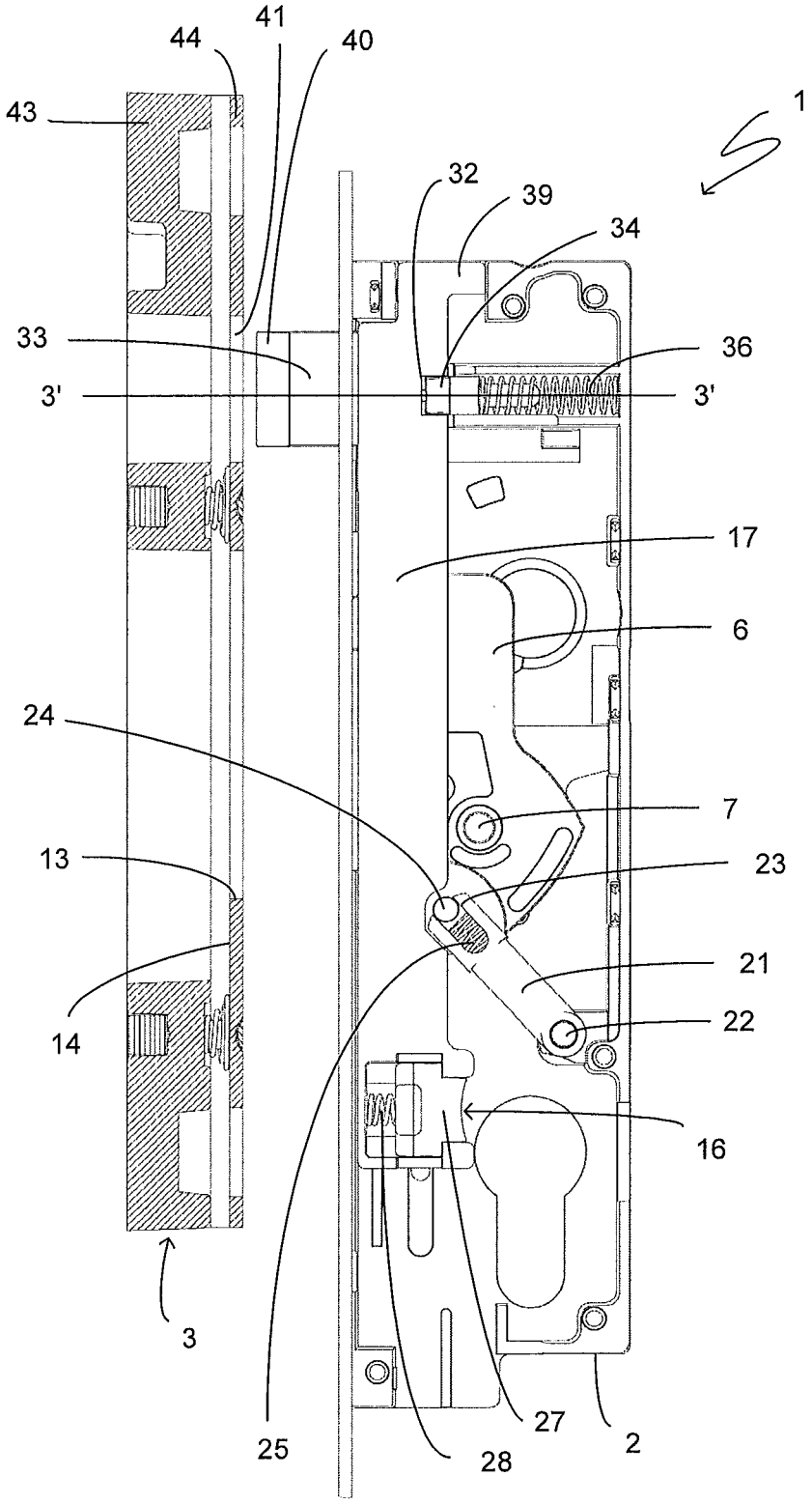
FIG. 2 is a cut away side view of the latch of FIG. 1, also in the unlatched position.
Figure 3:
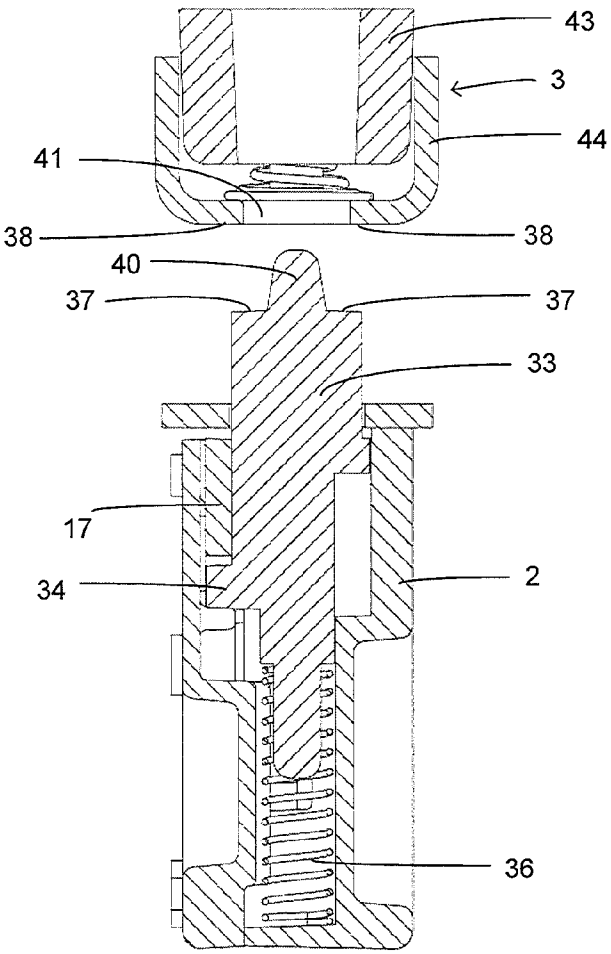
FIG. 3 is a cross-section along the line 3'-3' in FIG. 2.

FIGS. 1, 2 and 3 show a sliding door latch 1 according to one embodiment, in an unlatched position. FIGS. 1 and 2 are a cut away perspective view and a cut away side view respectively, each showing the internal workings of the latch, while FIG. 3 is a cross section along the line 3'-3' in FIG. 2.

Figure 6:
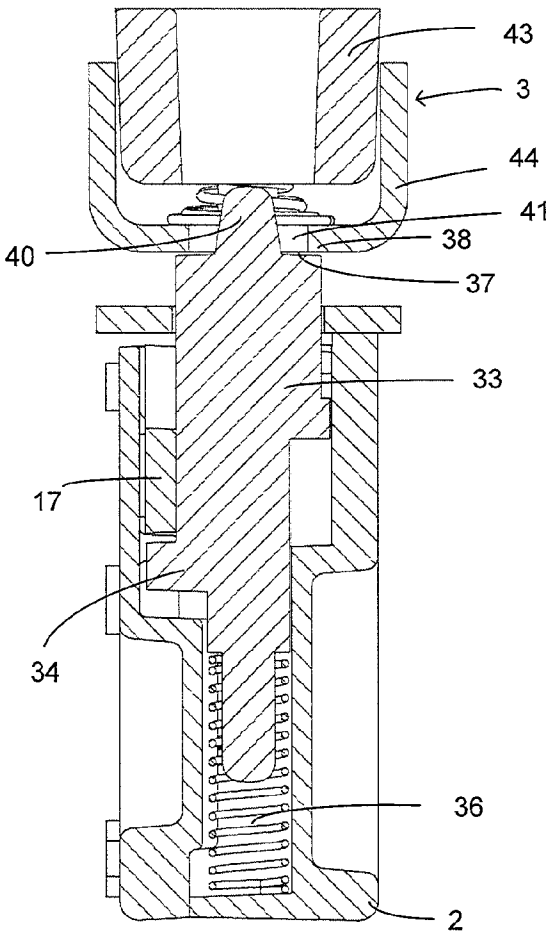
FIG. 6 is a cross-section along the line 6'-6' in FIG. 5.
Figure 4:
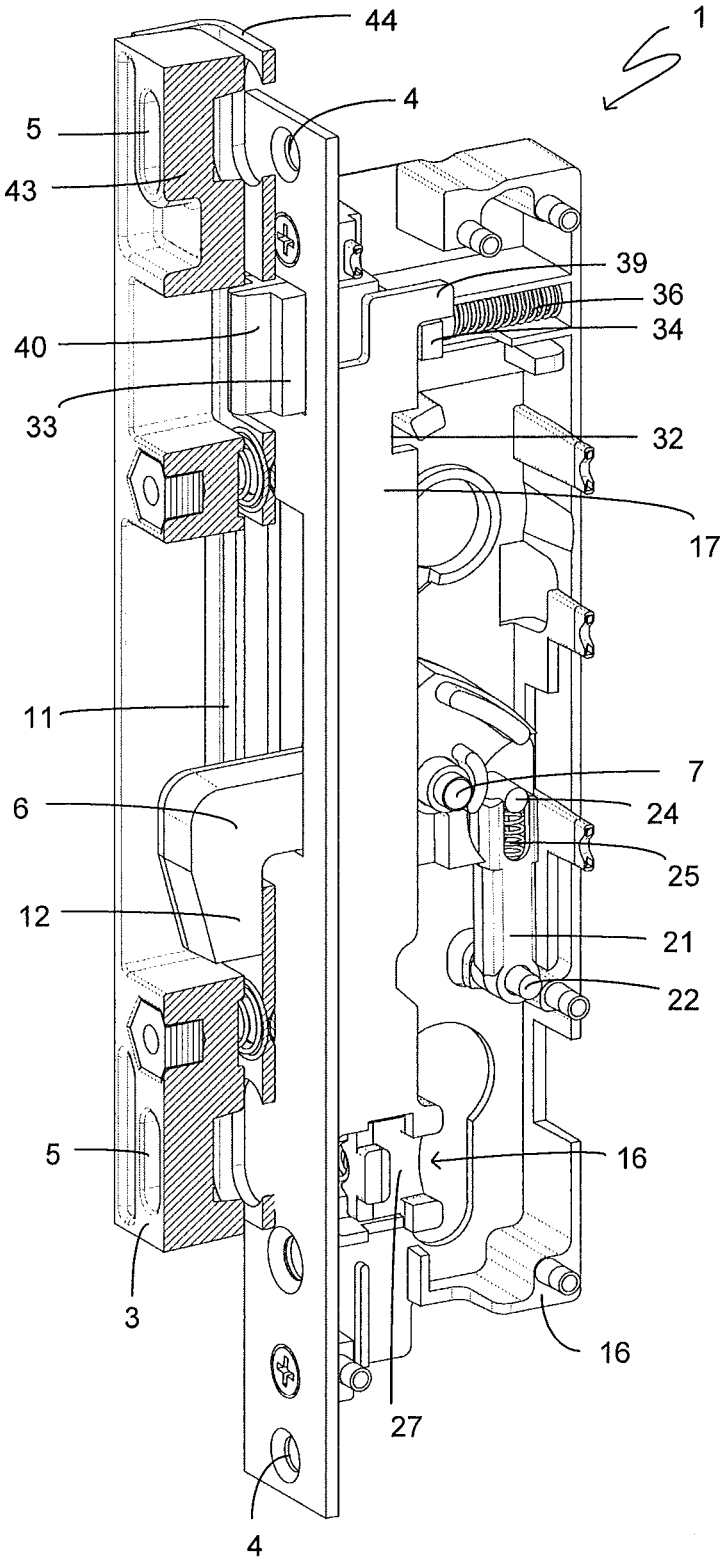
FIG. 4 is a cut away perspective view of the latch of FIG. 1, in a latched position.
Figure 5:
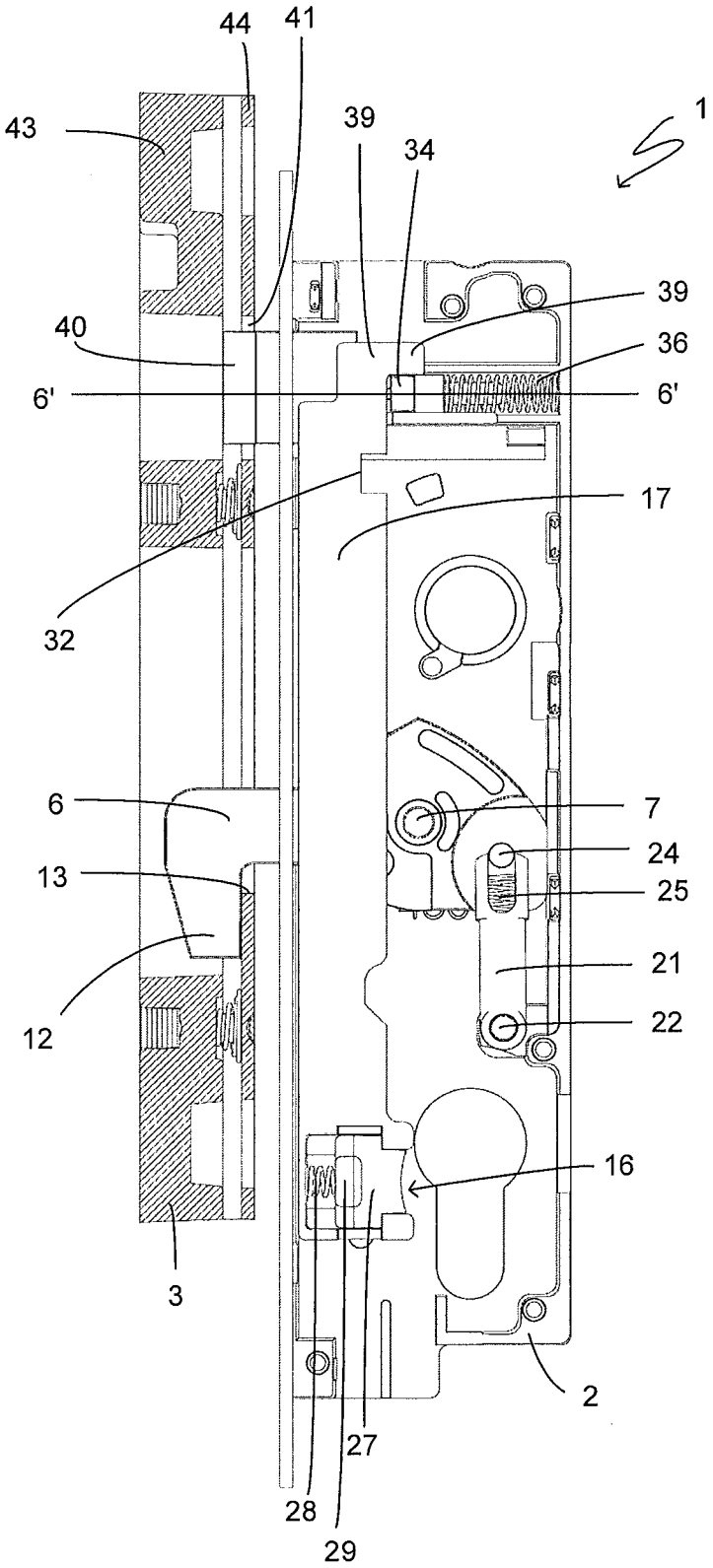
FIG. 5 is a cut away side view of the latch of FIG. 1, in the latched position.

FIGS. 4, 5 and 6 show the sliding door latch 1 of FIGS. 1 to 3, in a latched position. FIGS. 4 and 5 are a cut away perspective view and a cut away side view respectively, each showing the internal workings of the latch, while FIG. 6 is a cross section along the line 6'-6' in FIG. 5.

Figure 7:
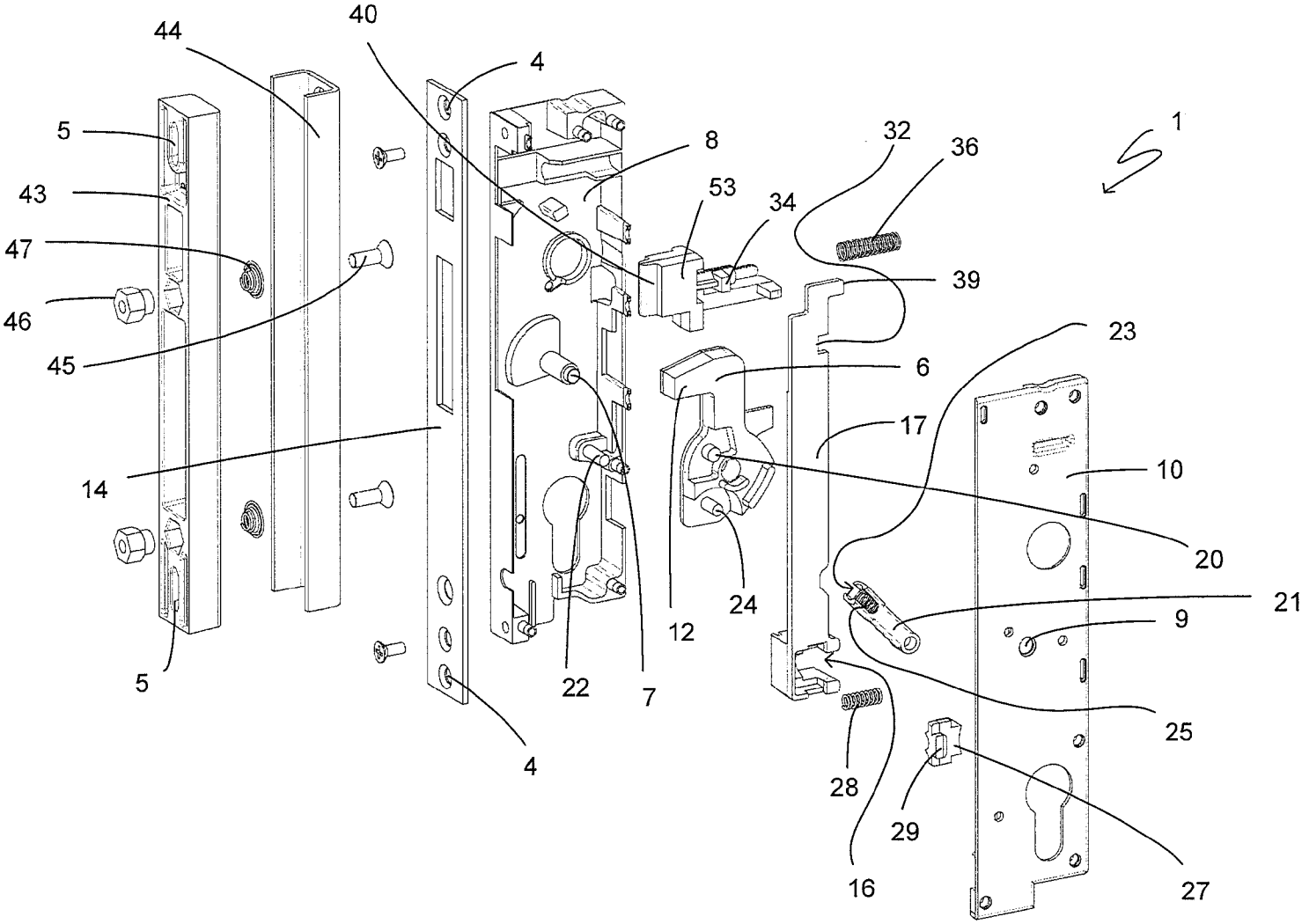
FIG. 7 is a first exploded view of the latch of FIG. 1.
Figure 8:
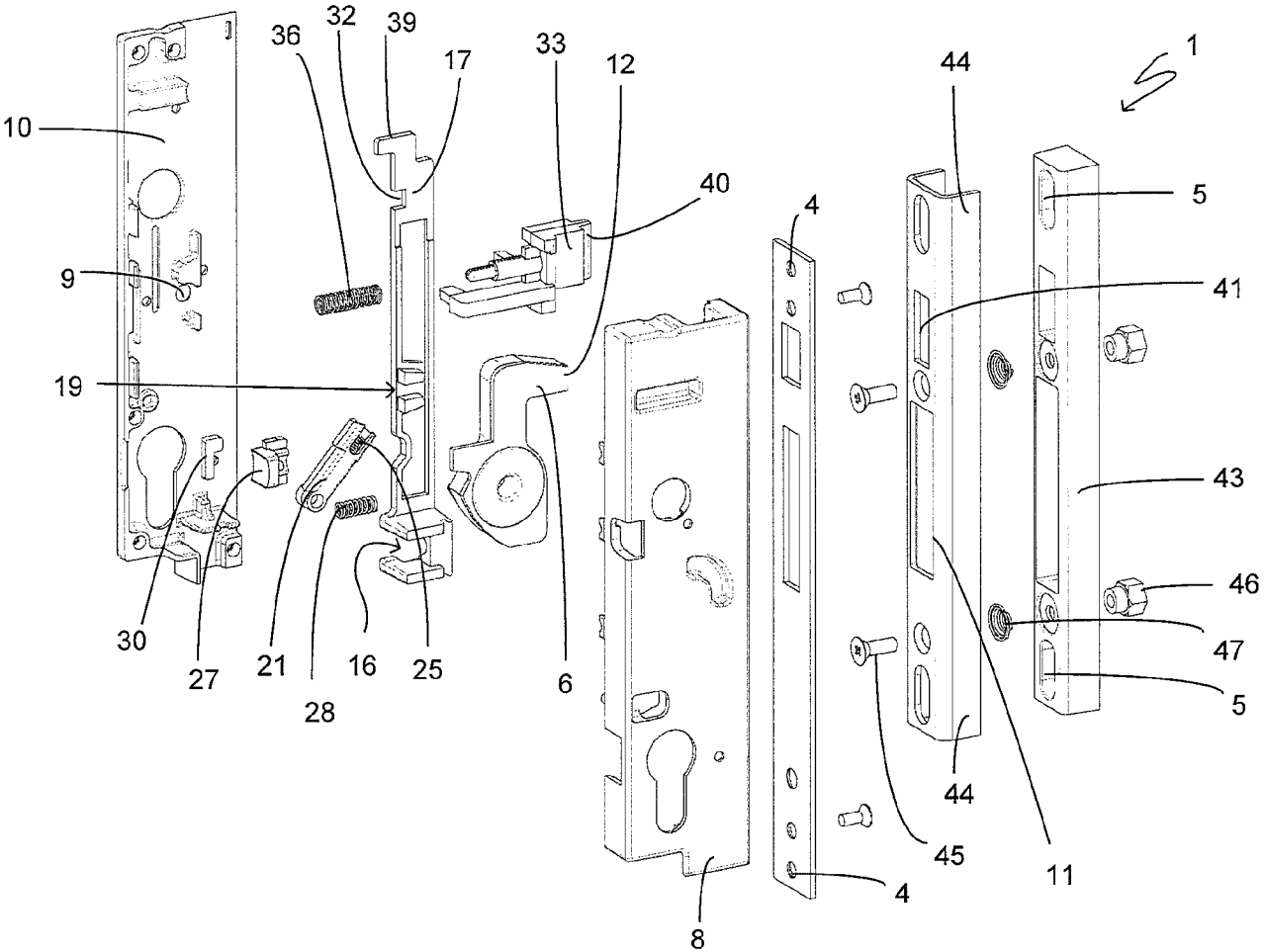
FIG. 8 is a second exploded view of the latch of FIG. 1.

FIGS. 7 and 8 are exploded views of the sliding door latch 1 of FIGS. 1 to 6, from opposite perspectives.

The latch 1 includes a latch body 2 and a strike 3. The latch body 2 is configured for attachment to a sliding door using fasteners engaged in holes 4, although any suitable attachment arrangement may be used. Similarly, the strike 3 is configured for attachment to a sliding door frame, or alternatively to a further sliding door panel, using fasteners engaged in holes 5, although any suitable attachment arrangement may be used. The holes 5 may be slightly elongate, which allows for adjustment of the strike position during installation.

The latch body includes one or more latching elements. In the embodiment shown a single latching element is used, in the form of a latch hook 6 mounted on a pin 7 about which it rotates. In other embodiments two or more latching elements, and/or other types of latching element may be used.

As shown in FIG. 7, the pin 7 may be formed integrally with one half 8 of a latch body housing, with a distal end of the pin 7 engaging in a support 9 formed in the other half 10 of the latch body housing. As shown, the support 9 may simply be a hole, and the pin 7 may have a shoulder formed near its distal end to rest against the inner wall of the latch body housing 10 when the distal end is received in the hole 9.

The latch hook 6 rotates about the pin 7 between a retracted, unlatched position as shown in FIGS. 1 to 3 and an extended, latched position as shown in FIGS. 4 to 6. In the latched position the latch hook 6 engages in a cooperating latching element 11 formed in the strike 3. The latching element may be an aperture in the strike 3, with the latch hook engaging around one edge of the aperture. Thus, in the latched position, the end portion 12 of the latch hook 6 engages with the lower edge 13 of the strike aperture and the wall 14 of the strike plate.

The motion of the latching element 6 may be driven by any suitable mechanism, including any suitable manual mechanism such as levers, handles, knobs, snibs etc. Preferably the latch is driven by a suitable lock cylinder, for example a cylinder allowing a key to be used from the outside or a knob to be used on the inside.

An engagement lug on the lock cylinder, or driven by the handle or knob engages with a formation 16 on drive element 17. Rotation of a key in the lock cylinder causes rotation of the engagement lug, applying a force to formation 16 to drive the drive element between the position shown in FIG. 2 and the position shown in FIG. 5. A further formation 19 (FIG. 8) on the drive element 17 engages with a pin 20 (FIG. 7) on the latch element 6. Movement of the drive element 17 therefore causes the latch element 6 to rotate about the pin 7 between the latched and unlatched positions.

An over centre arm 21 pivots around a first end on pin 22. The second end of the over centre arm 21 is formed with a slot 23 that rides on pin 24 on the latch hook 6. A spring 25 resides in the slot 23 to form a biased connection. As the latch hook 6 rotates about pin 7, the over centre mechanism applies an over centre action tending to force the latch hook to either the latched or the unlatched position.

The latching mechanism described above is one suitable mechanism. However, many different latching mechanisms are conceivable or known in the art, and will fall within the scope of protection.

The security, anti-lift and anti-slam mechanisms will now be described.

A security element or lug 27 sits within the formation 16 on the drive element 17. The security lug 27 is biased by a spring 28. When the drive element moves downwards to the position of FIG. 5, causing the latch hook to move to the latched position, the security lug 27 moves with the drive element until a projection 29 (FIG. 7) on the security lug engages behind an L-shaped formation 30 (FIG. 8) formed on the latch body housing 10. The circular path of the lock cylinder acts against the security lug 27, such that the projection 29 is forced around the short end of the L-shaped formation 30, but then returns under the bias of the spring 28 to sit in the angle of the L. In this position, any attempt to pry upwards on the latch hook 6 (e.g. using a screw driver) will be resisted because the drive element 17 is engaged with the latch hook 6, but the drive element cannot move upwards as the projection 29 on the security lug 27 is engaged below the L-shaped formation 30.

When a user operates the lock cylinder to unlatch the latch hook, the circular motion of the lock cylinder carries the projection 29 on the security lug 27 around the short leg of the L-shaped formation, and the drive element 17 is free to move.

The drive element 17 also includes an anti-slam formation, which in the embodiment shown is an anti-slam recess 32. The anti-slam recess 32 engages with a further anti-slam formation on protrusion 33. In the embodiment shown the further anti-slam element is an anti-slam lug 34.

The protrusion 33 is biased by a spring 36, which engages between the housing of the latch body 2 and the protrusion 33. This tends to force the protrusion 3 to extend from the latch body 2, i.e. to the left as shown in FIGS. 1 and 2.

In the position of FIGS. 1 and 2 the latch hook 6 cannot be moved to the latched position. This is because the drive element 17 is restrained by the engagement of the anti-slam lug 34 in the anti-slam recess 33. Any attempt to turn the lock cylinder or knob to move the latch hook to the latched position will therefore have no effect. This means that the door cannot be in an open position with the latch hook extending, and therefore prevents damage that might be caused to the latch by slamming the door with the latch hook extended.

However, when a user closes the door, the protrusion 33 engages with the strike 3 to release the anti-slam mechanism. In the embodiment shown the protrusion includes a shoulder 37, which engages with an anti-slam contact surface 38 on the front of the strike. In other embodiments the protrusion may engage with an anti-slam contact surface recessed in the strike.

As shown in FIG. 6, this engagement causes the protrusion 33 to move from the fully extended position (FIGS. 1 to 3) against the bias of the spring 36 to a partially extended position (FIGS. 4 to 6). Note that the protrusion 33 still extends from the latch body in the partially extended position.

In this partially extended position, the anti-slam lug 34 is in a disengaged position (see e.g. FIG. 4). In this position the drive element is no longer restrained by the anti-slam mechanism and if a user operates the latch, the latch hook 6 will freely move to the extended, latched position of FIGS. 4 and 5. In the latched position an end formation 39 on the drive element 17 may sit against the anti-slam lug 34.

Further, in the partially extended position an end or neck portion 40 of the protrusion 33 resides within a cut-out 41 in the strike 3. In the closed position of FIGS. 4 to 6, this provides an engagement between the latch body 2 and the strike 3 that prevents vertical forces exerted on the latch from displacing the latch body 2 relative to the strike 3, i.e. this is an anti-lift feature that prevents the disengagement of the latch hook 6 by lifting of the latch body 2.

The strike 3 may be formed as a two part strike, with a rear element 43 that, when installed, sits against the door or window frame, and a front element 44 mounted on the rear element 43. The front element 44 may be mounted to the rear element using cooperating screw fittings 45, 46 and springs 47 (FIGS. 7 and 8). These fittings allow some adjustment of the position of the front element 44 at the time of installation.

Figure 9:
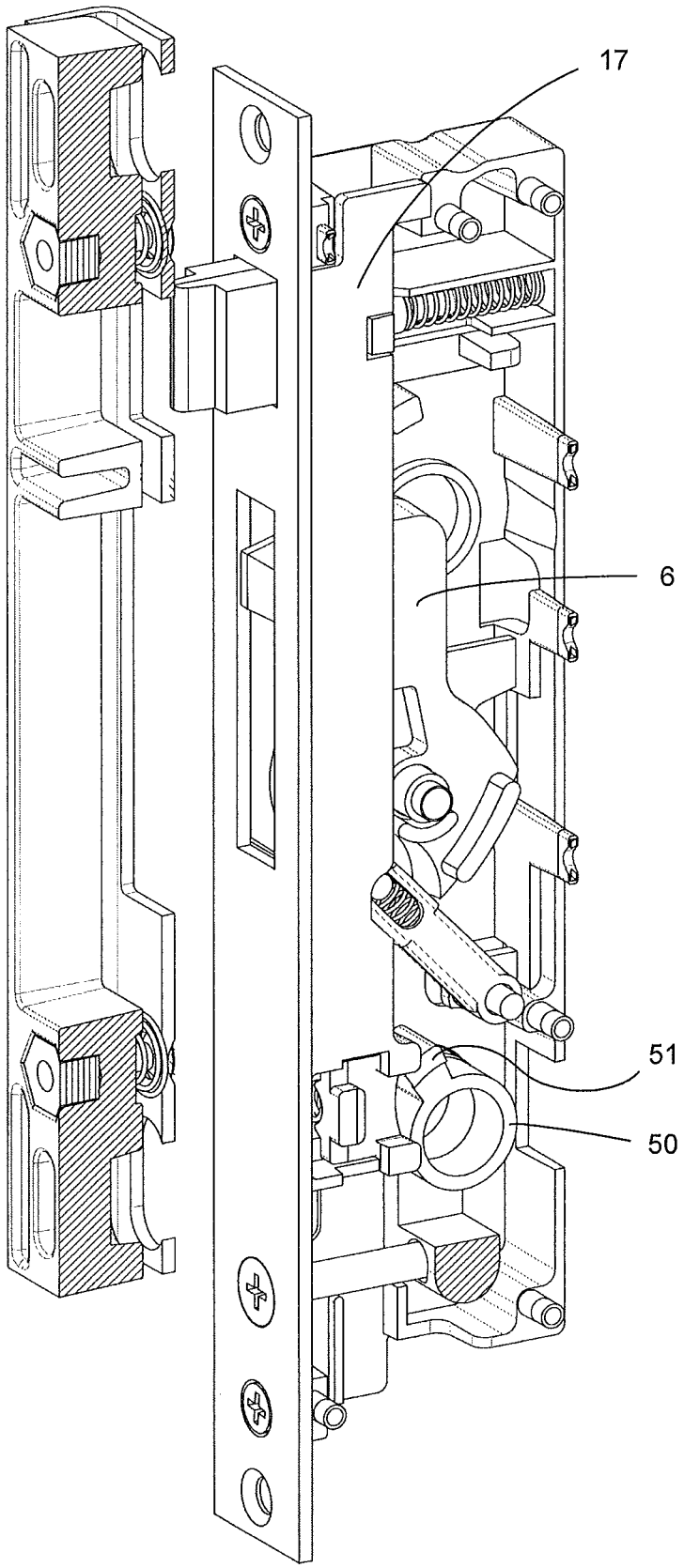
FIG. 9 is a similar view to FIG. 1, showing the position of a latch cam.
Figure 10:
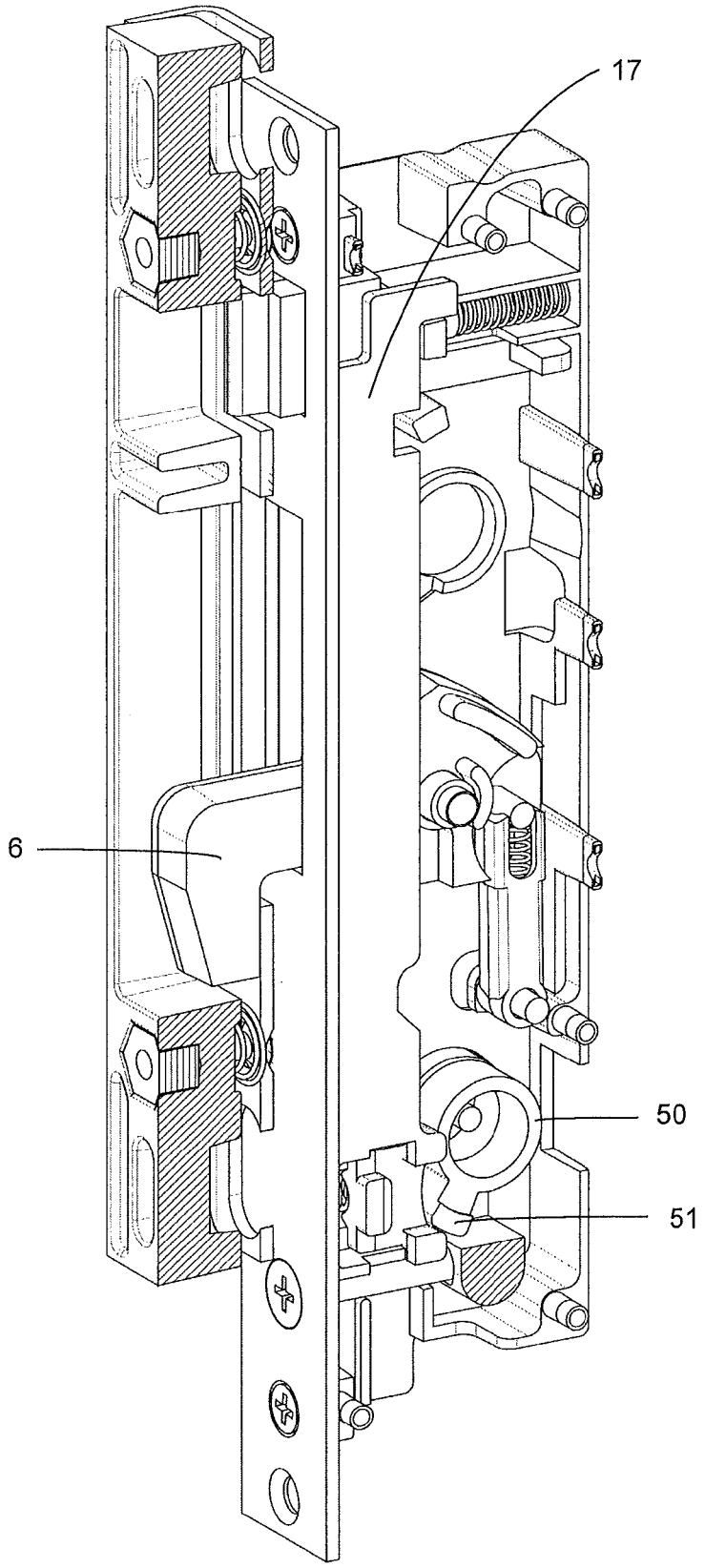
FIG. 10 is a similar view to FIG. 4, showing the position of the latch cam.

FIGS. 9 and 10 are similar views to FIGS. 1 and 4 respectively. FIG. 9 shows a latch cam 51 mounted on ring 50, which may be driven by any suitable actuator. FIG. 10 shows the position of the latch cam in the latched position. From the FIG. 9 position, the latch cam 51 has rotated downwards, forcing the drive element 17 to move downwards and causing the security lug 27 to move such that the projection 29 (FIG. 7) on the security lug engages behind the L-shaped formation 30 (FIG. 8).

Figure 11:
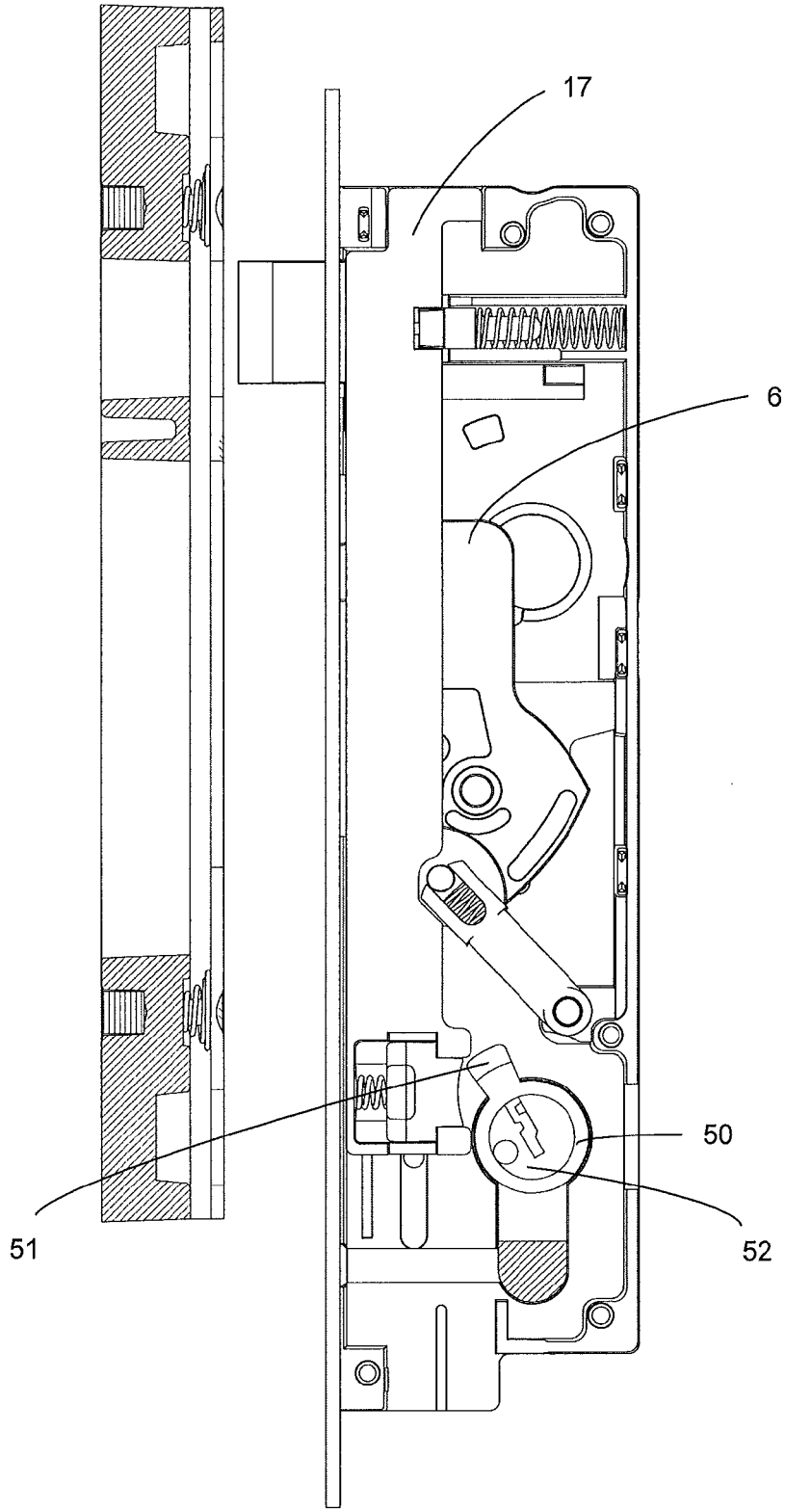
FIG. 11 is a similar view to FIG. 2, showing a lock cylinder and latch cam.
Figure 12:
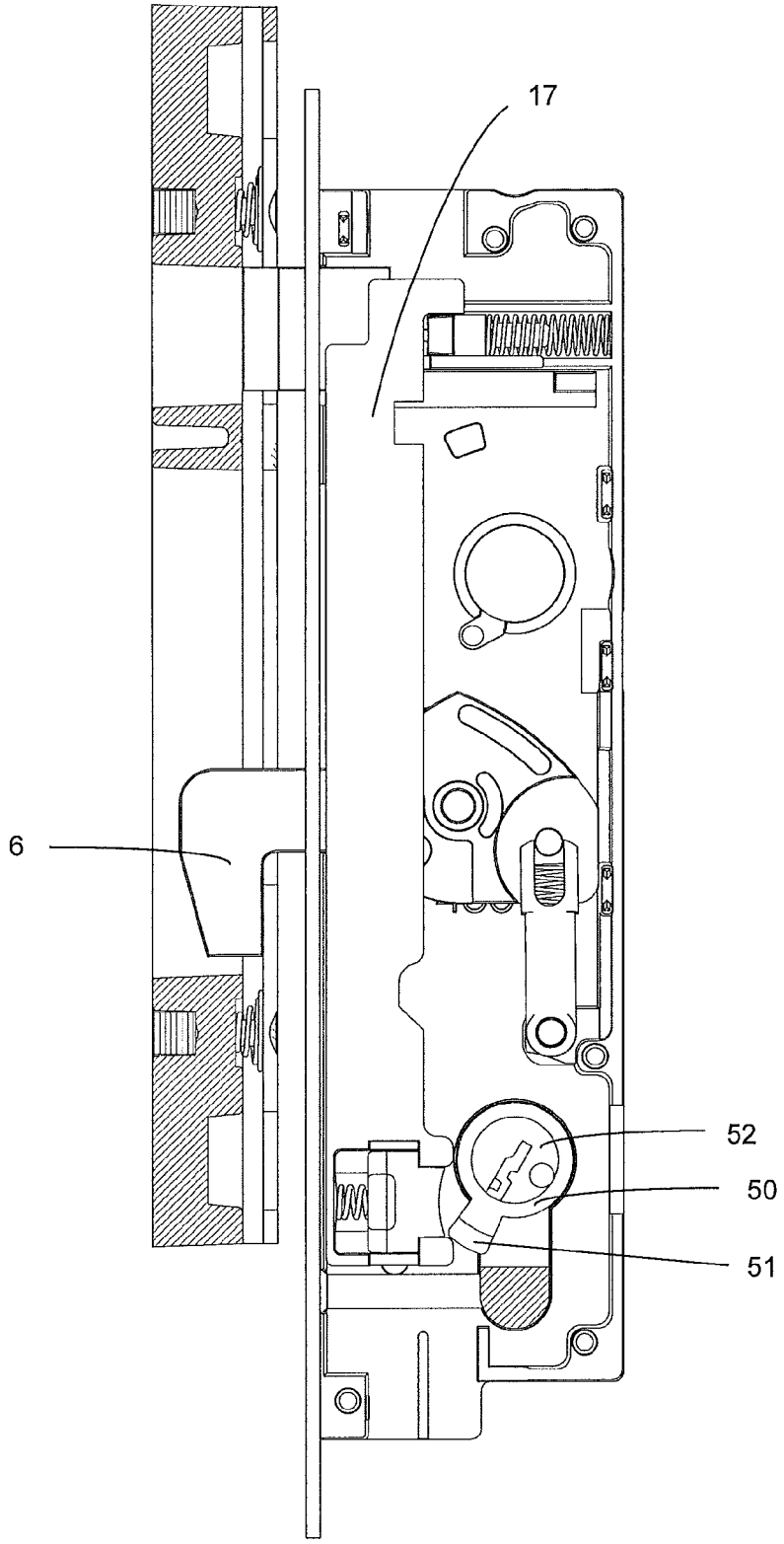
FIG. 12 is a similar view to FIG. 5, showing the lock cylinder and latch cam
Figure 14:
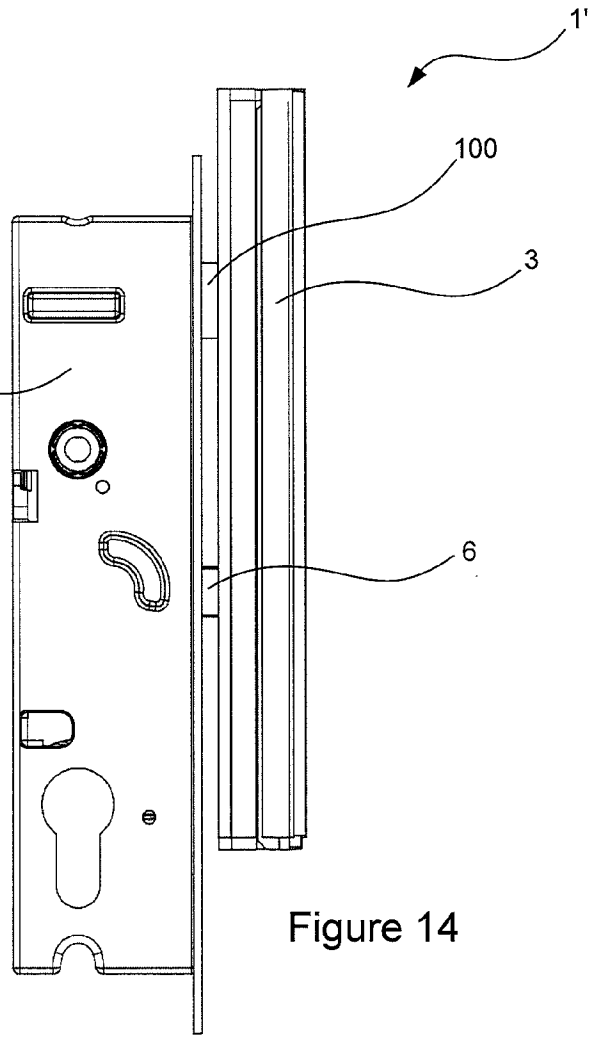
FIG. 14 is a further side view of the latch of FIG. 13, in a latched position.
Figure 13:
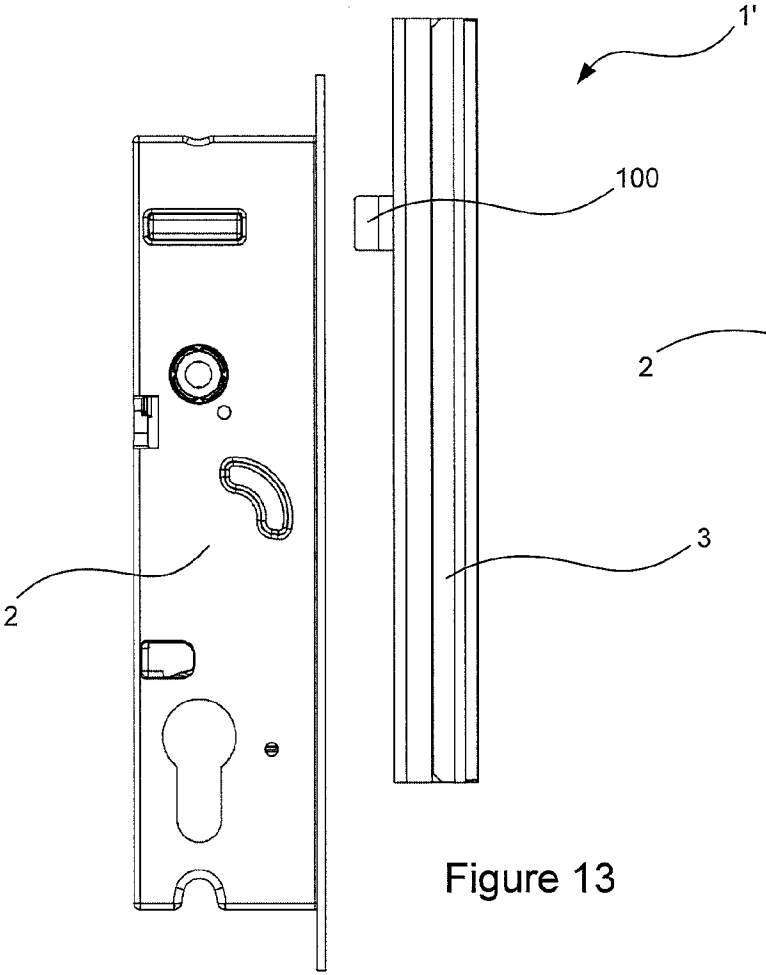
FIG. 13 is a side view of a latch according to another embodiment, in an unlatched position.

FIGS. 11 and 12 are similar views to FIGS. 2 and 5 respectively. These drawings show the position of a lock cylinder 52 configured to drive rotation of the latch cam 51.

In an alternative embodiment shown in FIGS. 13 to 16, the protrusion may be replaced by a fixed protrusion mounted on the strike. The protrusion engages with an anti-lift formation (e.g. an aperture) formed on the latch body, to provide the anti-lift function. In this embodiment the anti-slam mechanism is actuated by engagement of the protrusion with a moving anti-slam element within the latch body. In essence the moving protrusion discussed above is replaced by a fixed protrusion on the strike and a moving anti-slam element within the latch body.

Figure 16:
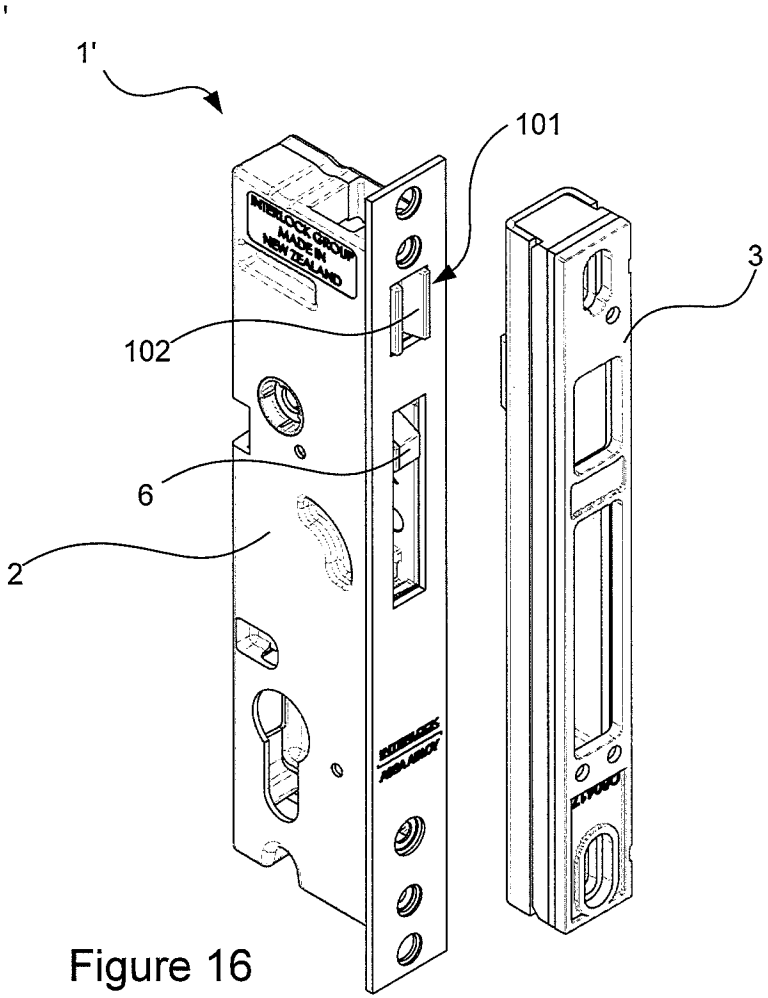
FIG. 16 is a further perspective view of the latch of FIG. 13, in the unlatched position.
Figure 15:
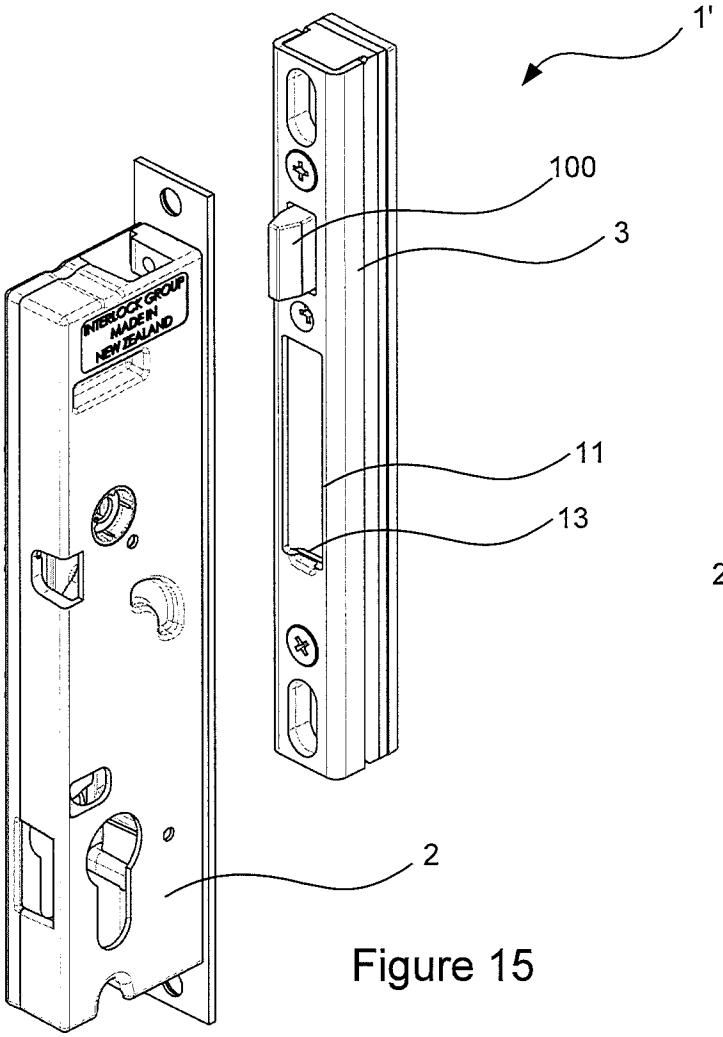
FIG. 15 is a perspective view of the latch of FIG. 13, in the unlatched position.

FIGS. 13 to 16 show a latch 1' including a latch body 2 and strike 3. A protrusion 100 is formed on the strike 3. The protrusion 100 may simply be a fixed protrusion. As shown in FIG. 16, the latch body 2 may include a recess 101 in which a plunger 102 is mounted. In the latched position of FIG. 14, the protrusion 100 travels into the recess 101 and depresses the plunger 102. The plunger 102 acts on the anti-slam mechanism in a similar manner to that described above with reference to FIGS. 1 to 12. Further, in this position the protrusion 100 engages with the top and bottom walls of recess 101 to prevent vertical movement of the latch body 2 with respect to the strike 3. This mechanism therefore provides anti-slam and anti-lift functions in a similar manner to FIGS. 1 to 12, but with the protrusion provided on the strike rather than the latch body. The skilled reader will understand that features of the latch of FIGS. 1 to 12 as discussed above may be provided in the latch of FIGS. 13 to 16.

The Applicant's latch provides a secure mechanism in a cost effective and robust manner. The protrusion 33, 100 provides both anti-slam and anti-lift functions in a robust and highly effective manner.

The Applicant's latch is described as a sliding door latch. However, in other embodiments the latch may be suitable for use with sliding windows.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. A sliding door or window latch, including:

i. a strike including:
  a) a latch engagement element;
  b) an anti-lift formation; and
  c) an anti-slam contact surface;

ii. a latch body, including:
  a) a latch housing;
  b) a latch member mounted in the latch housing, configured to move between: an unlatched position; and a latched position in which, in use, the latch member is positioned to engage with the latch engagement element;
  c) a protrusion that extends from the latch housing and is:
    movable between a fully extended position and a partially extended position; and
    biased to extend from the latch body to the fully extended position;
  d) an anti-slam mechanism including the protrusion and actuated by movement of the protrusion, wherein the anti-slam mechanism restricts motion of the latch member from the unlatched position when the protrusion is in the fully extended position but allows motion of the latch member from the unlatched position when the protrusion is in the partially extended position;
  e) a drive element operatively connecting the protrusion to the latch member; and
  f) a security element mounted on the drive element and a formation on the latch housing configured to prevent unlatching motion of the latch member, wherein the security element is caused to disengage from the formation on the latch housing by unlatching motion of a user actuator;
    wherein, when, in use, a sliding door or window to which the latch is mounted is moved to a closed position, the protrusion:
      contacts the anti-slam contact surface and is forced by relative movement of the strike and latch body to move from the fully extended position to the partially extended position, thereby actuating the anti-slam mechanism to allow movement of the latch member from the unlatched position; and
      engages with the anti-lift formation thereby preventing vertical movement of the latch body relative to the strike.

2. The latch as claimed in claim 1, wherein the protrusion includes a shoulder that contacts the anti-slam contact surface and an end portion extending beyond the shoulder that engages in the anti-lift formation.

3. The latch as claimed in claim 1, wherein the latch member is a latch hook and the latch engagement element is an aperture in the strike.

4. The latch as claimed in claim 1, wherein the drive element driven by a user actuator and configured to drive movement of the latch member between the latched and unlatched positions, wherein the anti-slam mechanism includes a first anti-slam formation on the drive element and a second anti-slam formation that engages with the first anti-slam formation to prevent movement of the drive element.

5. The latch as claimed in claim 4, wherein movement of the protrusion from the fully extended position to the partially extended position causes disengagement of the second anti-slam formation from the first anti-slam formation, thereby allowing movement of the drive element.

6. The latch as claimed in claim 1, wherein the anti-slam contact surface is a front surface of the strike.

7. The latch as claimed in claim 1, wherein the anti-slam contact surface is recessed within the strike.

8. The latch as claimed in claim 1, wherein the strike includes a rear element configured for fixing to a door or window frame or a sliding door or window panel, and a front element adjustably mounted to the rear element.

9. The latch as claimed in claim 8, wherein the anti-lift formation is formed in the front element.

10. The latch as claimed in claim 1, wherein the anti-lift formation is an aperture in the strike.

11. A sliding door or window latch, including:

a strike including:

a) a latch engagement element;

b) an opening defining an anti-lift formation; and c) an anti-slam contact surface;

a latch body, including:

a) a latch housing;

b) a latch member mounted in the latch housing, configured to move between: an unlatched position; and a latched position in which, in use, the latch member is positioned to engage with the latch engagement element;

c) a protrusion that extends from the latch housing and is movable between a fully extended position and a partially extended position; and biased to extend from the latch housing to the fully extended position, the protrusion comprising a neck portion;

d) a drive element operatively connecting the protrusion to the latch member;

e) an anti-slam mechanism that restricts motion of the latch member from the unlatched position when the protrusion is in the fully extended position but allows motion of the latch member from the unlatched position when the protrusion is in the partially extended position, the anti-slam mechanism comprises an anti-slam formation on the drive element that cooperates with an anti-slam element on the protrusion, and a protrusion surface that interacts with the anti-slam contact surface;

wherein, when, in use, the sliding door or window to which the latch is mounted is moved to a closed position, the neck portion is received into the opening to allow the protrusion surface to contacts the anti-slam contact surface and is forced by relative movement of the strike and latch housing to move the protrusion from the fully extended position to the partially extended position, thereby moving the drive element to allow movement of the latch member from the unlatched position; and the neck portion engages with the anti-lift formation thereby preventing vertical movement of the latch housing relative to the strike.

* * * * *